US011925230B2

(12) United States Patent
Blythe

(10) Patent No.: US 11,925,230 B2
(45) Date of Patent: Mar. 12, 2024

(54) CHINSTRAP SOCK WITH METAL-CONTAINING YARN

(71) Applicant: DRYMAX TECHNOLOGIES, INC., Paso Robles, CA (US)

(72) Inventor: William A. Blythe, Paso Robles, CA (US)

(73) Assignee: DRYMAX TECHNOLOGIES, INC., Paso Robles, CA (US)

( * ) Notice: Subject to any disclaimer, the term of this patent is extended or adjusted under 35 U.S.C. 154(b) by 151 days.

(21) Appl. No.: 16/840,378

(22) Filed: Apr. 4, 2020

(65) Prior Publication Data

US 2020/0315278 A1 Oct. 8, 2020

Related U.S. Application Data

(60) Provisional application No. 62/830,064, filed on Apr. 5, 2019.

(51) Int. Cl.

| | |
|---|---|
| ***A42B 3/08*** | (2006.01) |
| ***A42B 3/04*** | (2006.01) |
| ***D04B 1/10*** | (2006.01) |
| ***D04B 1/22*** | (2006.01) |

(52) U.S. Cl.

CPC ..... *A42B 3/08* (2013.01); *A42B 3/0406* (2013.01); *D04B 1/106* (2013.01); *D04B 1/22* (2013.01); *D10B 2401/021* (2013.01); *D10B 2401/022* (2013.01); *D10B 2507/00* (2013.01)

(58) Field of Classification Search

CPC ..... A42B 3/08; A42B 3/0406; D04B 1/106; D04B 1/12; D04B 1/18; D04B 1/22; D10B 2401/021; D10B 2401/022; D10B 2101/20

USPC ..... 2/421

See application file for complete search history.

(56) References Cited

U.S. PATENT DOCUMENTS

| | | | | |
|---|---|---|---|---|
| 3,975,929 | A * | 8/1976 | Fregeolle | D04B 1/18 66/178 A |
| 4,548,057 | A | 10/1985 | Essig | |
| 4,843,653 | A * | 7/1989 | Coble | D04B 1/22 2/169 |
| 5,163,306 | A | 11/1992 | Boehm et al. | |
| 5,561,861 | A | 10/1996 | Lopez et al. | |
| 5,577,397 | A | 11/1996 | Iida | |

(Continued)

OTHER PUBLICATIONS

Team Sport Products 2017. Drymax Technologies. 2017. Retrieved from internet: http://www.drymaxsports.com/files/trade/Drymax-team-brochure-2017.pdf (Year: 2017).*

*Primary Examiner* — Aiying Zhao

(74) *Attorney, Agent, or Firm* — Christopher J. Knors; Moore & Van Allen PLLC

(57) ABSTRACT

A chinstrap sock to be worn by athletes comprising a tubular body having a skin facing surface for contacting a portion of a wearer's body, and an outer surface opposed to the skin facing surface; an opening in the tubular body for extension therethrough; and a first welt and a second welt affixed to opposite ends of the tubular body in surrounding relation to the opening, the first welt and the second welt each comprising a circularly-knitted fabric integral with the tubular body and extending therefrom to; the tubular body portion being a knitted construction comprising: a skin-facing surface comprising a metal-, metal oxide-, and/or metal salt-containing yarn portion.

9 Claims, 1 Drawing Sheet

(56) References Cited

U.S. PATENT DOCUMENTS

| | | | | |
|---|---|---|---|---|
| 5,823,012 | A * | 10/1998 | Hacskaylo | D04B 1/126 66/171 |
| 6,209,363 | B1 | 4/2001 | Jordan | |
| 6,499,320 | B1 * | 12/2002 | Bernhardt | A41B 11/00 66/178 R |
| 6,688,142 | B2 | 2/2004 | Higgins | |
| 6,735,988 | B1 | 5/2004 | Honeycutt | |
| 6,761,048 | B2 | 7/2004 | Okamoto | |
| 6,789,402 | B2 | 9/2004 | Okamoto | |
| 7,213,420 | B2 | 5/2007 | Lynch et al. | |
| 7,328,595 | B2 | 2/2008 | Lonati et al. | |
| 7,752,681 | B2 | 7/2010 | Michel | |
| 7,937,972 | B2 | 5/2011 | Busi | |
| 8,156,768 | B2 | 4/2012 | Green et al. | |
| 9,655,388 | B2 | 5/2017 | Michel | |
| 9,956,123 | B2 | 5/2018 | Dan-Jumbo | |
| 10,292,447 | B2 | 5/2019 | Connelly et al. | |
| 2002/0152775 | A1 * | 10/2002 | Browder, Jr. | A41C 1/003 66/170 |
| 2003/0131635 | A1 | 7/2003 | Lynch et al. | |
| 2003/0192351 | A1 * | 10/2003 | Meckley | D04B 1/243 66/170 |
| 2004/0003630 | A1 * | 1/2004 | Akers | D04B 1/225 66/197 |
| 2006/0010931 | A1 | 1/2006 | Lynch et al. | |
| 2007/0083986 | A1 * | 4/2007 | Kaiser | A42B 3/08 2/410 |
| 2012/0122364 | A1 * | 5/2012 | Menczywor | B32B 5/12 442/306 |
| 2016/0262470 | A1 * | 9/2016 | Blythe | A41D 20/00 |
| 2021/0277551 | A1 * | 9/2021 | Blythe | D04B 1/24 |

* cited by examiner

CHINSTRAP SOCK WITH METAL-CONTAINING YARN

TECHNICAL FIELD

A chinstrap sock structure having a knitted-in fiber comprising metal and a method of manufacturing such a chinstrap sock are described. The chinstrap sock is knit using a patterning mechanism to form a tubular body having one or more individual courses, each of which have adjacent wales knit from at least one yarn comprising metal-containing fiber.

BACKGROUND

During athletic activity, personal protection gear which contacts the skin surface of the wearer inevitably collects perspiration and body oils, leading to the possibility of rashes and other skin conditions. For example, in football, a helmet typically includes a chinstrap, for securing the helmet to the user that is in constant contact with the lower extremity of wearer's face. Conventional chinstrap add-ons include those that are formed from a knitted or woven length fabric by initially cutting a desired length of tubular fabric structure and then forming axially turned welts at the opposite ends of the tubular fabric where yarn of the tubular fabric is included in the turned welt. As the functional purpose of this yarn is not needed or desired in the turned welt, as well as requiring extra processing steps, undesirable additional overall cost is added. Moreover, the conventional chin strap add-ons lack the ability to prevent or eliminate skin-related effects caused by the contact of the skin of the wearer during use.

SUMMARY

In a first example, a chinstrap sock is provided, the chinstrap sock comprising a tubular body having a skin facing surface for contacting a portion of a wearer's body, and an outer surface opposed to the skin-facing surface, an opening in the tubular body for receiving a chinstrap, and a first welt and a second welt defining opposite ends of the tubular body, each of the first welt and the second welts being in surrounding relation to the opening, the first welt and the second welt each integral with the tubular body. The tubular body is of a knitted construction comprising a yarn containing a metal-, metal oxide-, and/or metal salt-containing fiber positioned between both of the first welt and the second welt of the skin facing surface.

In one aspect, the tubular body is a circularly-knitted fabric and the first welt, and the second welt are each a circularly-knitted fabric integral with the tubular body. In another aspect, alone or in combination with any one of the previous aspects the metal-, metal oxide-, and/or metal salt-containing fiber comprises copper or silver.

In another aspect, alone or in combination with any one of the previous aspects, the tubular body of the chinstrap sock includes an elastic make up yarn. In another aspect, the first welt and the second welt are of a turned welt configuration.

In another aspect, alone or in combination with any one of the previous aspects, the skin-facing surface comprises a hydrophobic yarn and the outer surface comprises a moisture absorbing yarn opposed to the skin facing surface.

In another aspect, alone or in combination with any one of the previous aspects, the skin-facing surface comprises a hydrophobic yarn and the outer surface comprises a moisture wicking yarn opposed to the skin facing surface. In another aspect, the skin-facing surface comprises a hydrophobic moisture wicking yarn, and the outer surface comprise a moisture wicking yarn adjacent a moisture absorbing yarn.

the skin-contacting surface comprises the metal-, metal oxide-, and/or metal salt-containing hydrophobic yarn extending from both of the opposite ends of the tubular body.

In another aspect, alone or in combination with any one of the previous aspects, the at least one yarn with a metal-containing fiber is formed in needle loops extending in circumferential courses and axial wales, the turned welt comprising a welt beginning course, a welt ending course, and a plurality of intervening courses, the welt beginning and welt ending courses being connected with one another by a set of connecting needle loops formed in selected spaced wales. In another aspect, the intervening courses comprise needle loops formed only in wales other than the selected spaced wales. In yet another aspect, intervening course comprises yarn floats across the selected spaced wales to provide indicia.

In another aspect, alone or in combination with any one of the previous aspects, the chinstrap sock has a first annular region having courses formed of alternating needle loops and yarn floats and courses formed of successive needle loops, and a second annular region adjacent the first annular region having courses formed of alternating needle loops and tuck stitches and courses formed of successive needle loops.

In another example, a chinstrap sock is provided comprising a tubular body having a skin facing surface for contacting a portion of a wearer's body, and an outer surface opposed to the skin-facing surface; an opening in the tubular body for receiving a chinstrap; and a first welt and a second welt defining opposite ends of the tubular body, each of the first welt and the second welts being in surrounding relation to the opening, the first welt and the second welt each integral with the tubular body; the tubular body being of a knitted construction comprising a metal-, metal oxide-, and/or metal salt-containing hydrophobic yarn, optionally in combination with elastic yarns, configured to be presented substantially to a wearer's skin; and hydrophilic yarn, optionally in combination with elastic yarn, adjacent to the hydrophobic yarns, the hydrophilic yarn configured to be distal the wearer's skin.

In another example, a method of preventing or eliminating skin-related adverse effects to the face of a user in need thereof is provided, the method comprising providing a chin sock as described in any of the previous examples are aspects, configured for use with a chinstrap of an athletic helmet; and preventing or eliminating skin-related adverse effects. In one aspect, the adverse effects are one or more of heat rash, sweat rash, acne, folliculitis, bacterial infection, and fabric-induced dermatitis.

DETAILED DESCRIPTION

Figure 1:
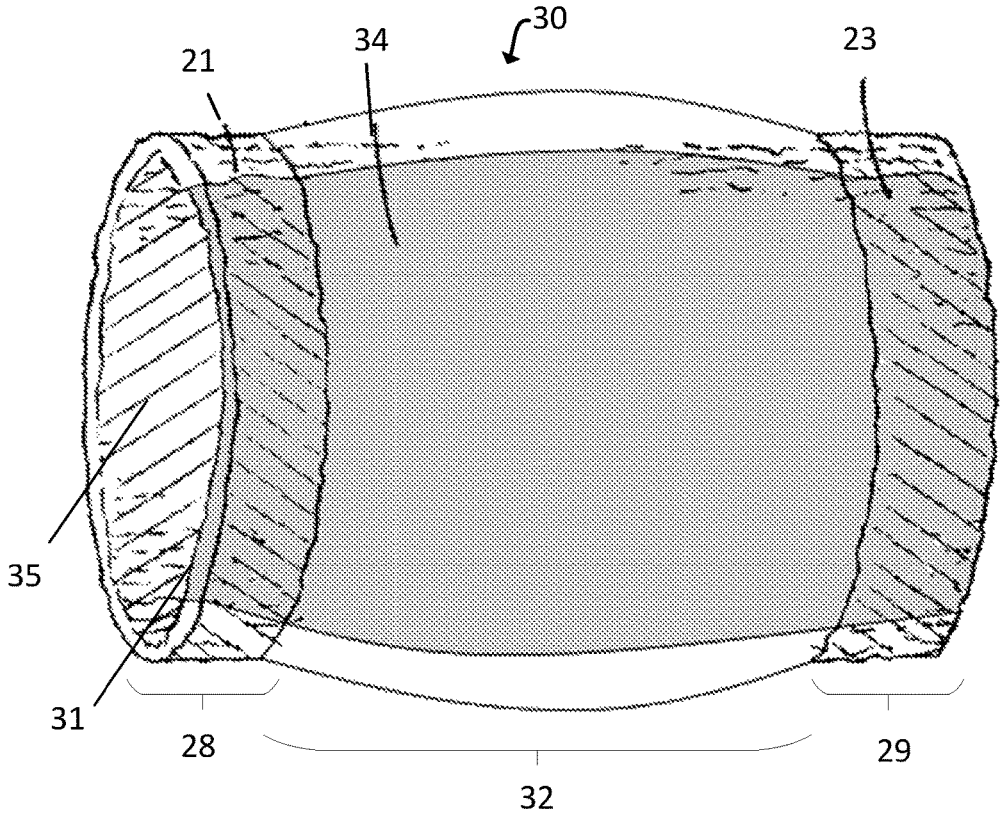
FIG. 1 depicts a perspective view of a chinstrap sock in accordance with the present disclosure.

As used herein, the phrase "adverse effects" is inclusive of heat rash, sweat rash, acne, folliculitis, bacterial infection, and fabric-induced dermatitis.

As used herein, the phrase "single yarn" is intended to mean that the same yarn from a single feed forms a course or wale. The single yarn can be a single-ply or multi-ply yarn or a group of yarns, for example, the singularly fed yarn can include plural yarns being provided as one to the needles.

As used herein the phrases "metal-containing fiber," "metal-containing single yarn" and "metal-containing yarn" are inclusive of fibers/yarns coated with metal-, metal oxide-, and/or metal salt, impregnated with metal-, metal oxide-, and/or metal salt, or containing particles of metal-, metal oxide-, and/or metal salt-dispersed therein. Metal-, metal oxide-, and/or metal salt-containing fiber/yarn, as used herein, is inclusive of copper containing fiber/yarn and silver containing fiber/yarn.

As used herein, the term "tubular" encompasses a tube shape, e.g., a hollow, elongated body or part with an internal diameter, an external diameter, and a length, including an elongated body or part with substantially constant or fixed internal and external diameters along its length. Tubular encompasses an elongated body or part with variable internal and external diameters along its length, where the ratio of the internal and external diameters are substantially constant along the length or where the ratio of the internal and external diameters vary along the length. With regard to a knitted tubular body, it is understood that variations in yarn and fiber thicknesses, among other variables during the knitting operation, can provide for slight variations in the internal diameter and external diameter along the length of the elongated body or part, such that the terms "constant or fixed" are understood to encompass such variation. Likewise, it is understood that variations in variables during the knitting operation can provide for deliberate variations in the internal diameter and external diameter along the length of the elongated body or part, either in a fixed ratio of such diameters or with variation in the ratios of such diameters so as to accommodate the tubular body to accept and/or receive chin straps of various dimensions.

Used herein, the phrases "inner surface" and "non-skin facing surface," with reference to the knitted tubular body, are used interchangeably and refer to the surface(s) of the tubular body in direct contact with or facing the chinstrap or the chinstrap surface. Likewise, as used herein, the phrases "inner section," "inner portion," "non-skin facing portion," and "non-skin facing section," with reference to the knitted tubular body, are used interchangeably.

As used herein, the phrases "outer surface" and "outer portion" with reference to the knitted tubular body encompass a "skin facing surface" or "skin-side," and its opposing surface of the tubular body. As used herein, each of the phrases "skin facing surface," "skin facing section," "skin-side," and "skin facing portion" exclude the corresponding opposing outer surface, opposing outer section, and opposing outer portion with reference to the knitted tubular body.

As used throughout this application, the term "hydrophilic yarns" and its grammatical equivalents mean yarns having an affinity for moisture and/or water or readily absorbing or wicking water, or liquid compositions of biological origin comprised mostly of water, e.g., sweat and/or perspiration. The hydrophilic properties of the yarn may be intrinsic to the materials used to form the yarn, or the hydrophilic properties may be imparted to the yarn by treating the yarn with one or more hydrophilic compositions.

As used throughout this application, the term "hydrophobic yarns" and its grammatical equivalents mean yarns having an essentially no affinity for moisture and/or water or that essentially resist absorbing water, or liquid compositions of biological origin comprised mostly of water, e.g., sweat and/or perspiration. The hydrophobic properties of the yarn may be intrinsic to the materials used to form the yarn, or the hydrophobic properties may be imparted to the yarn by treating the yarn with one or more hydrophobic compositions.

A chinstrap sock is provided for preventing adverse effects to a wearer's face and/or to improve skin appearance of the wearer after athletic activity involving the use of a helmet equipped with a chinstrap. The chinstrap sock is configured for receiving a chinstrap of an athletic helmet or the like, the chinstrap sock comprising a tubular body having an outer/skin facing surface for contacting a portion of a wearer's body and an inner/non-skin facing surface for contacting a portion of the chinstrap, is provided. The chinstrap sock comprises a tubular body with an opening therethrough for receiving a chinstrap, the tubular body beginning at a first welt and terminating at a second welt at opposite ends of the tubular body in surrounding relation to the opening, the first welt and the second welt each comprising a circularly-knitted fabric integral with the tubular body, the tubular body comprising: a skin-facing surface comprising a metal-containing yarn; and wherein the metal-containing yarn is adjacent to one or both of the first welt and the second welt. In another example, the metal-containing yarn portion extends through the one or both of the first welt or the second welt.

In one example, the chinstrap sock comprises a tubular body that has a defined tubular length, with a first welt section and a second welt section having a body section therebetween; one or more sections of the tubular length being knit from at least one yarn. In one example, the tubular body knit to form the chinstrap sock has a portion of its length and/or width formed from a yarn comprising one or more "functional" fibers designed to enhance particular performance characteristics of the chinstrap sock for an athletic activity, including, but not limited to enhanced wicking, antimicrobial resistance, moisture absorption, or thermal regulating functionality. In one example, the at least one yarn comprising one or more functional fibers comprises a metal-containing yarn. In another example, the metal-containing yarn is a copper containing yarn. It is understood that the yarn can be comprised of one or more natural or synthetic functional fibers, for example, natural or synthetic fibers that comprise metal, such as copper or silver. Natural or synthetic functional fibers that comprise metals include metal-impregnated or metal-infused fibers, for example.

In one example, a small diameter yet relatively long tubular body suitable for the manufacture of a chinstrap sock is jacquard knit or jersey knit or plain knit such that selected adjacent wales in one or more of the individual courses are knit from distinct yarns, for example, to form a design or discrete structure or pattern in at least a portion of the first welt section, the second welt section, or the body section of the tubular body so as to provide specific functionality for use of the chinstrap sock. The design or discrete structure or pattern can be uniform or non-uniform across the length or width of the tubular body and can be on one or both opposing outer surfaces. Specific functionality in at least a portion of the tubular body can extend to the welts of the tubular body or can extend through the entirety of the welts. Specific functionality in at least a portion of the tubular body can wrap around the outer surfaces of the tubular body at one or both ends thereof.

In one example, a tubular body is knit to a length approximating the desired length for the chinstrap sock, for example, sized to receive within the opening of the tubular body at least a portion of a chin strap of an athletic helmet.

The desired length and diameter of the tubular body can be adjusted for different sized chin straps associated with different sized chin straps. Athletic helmets can include football helmets, lacrosse helmets, rugby helmets, boxing helmets, and the like.

In one example the chinstrap sock comprises an outer skin facing surface and an opposed outer surface of the tubular body, where each of the outer skin facing surface and the opposed outer surface are knit from at least two yarns where at least one of the at least two yarns contains functional fiber. In one example, at least one of the at least two yarns contains functional fiber provide functionality such as wicking, absorbing, antimicrobial resistance, or insulating that results in the completed chinstrap sock having improved performance properties. In another example, in the production of a chinstrap sock, one or more sections of the tubular body are knit from at least three yarns where at least one of the at least three yarns contains functional fiber that improve performance capabilities and/or properties of the resultant chinstrap sock, such as a yarns that provide wicking, absorbing, antimicrobial resistance, or insulating functionality.

At least a portion of the tubular body of the chinstrap sock can be patterned, have text, or have a random visual appearance by appropriate selection of the pattern mechanism and the use of one or more color-contrasting yarns. In one example, the chinstrap socks of the instant disclosure can have a design as a part of the chinstrap sock fabric structure itself. The design can be with or without one or more yarns with functional fibers. Thus, in one example the chinstrap sock is knit using a patterning mechanism, and the yarn forming each individual course are varied along the length of the knit course such that adjacent wales in an individual course are selectively knit from visually distinct yarns, to provide a design. In one example, the design is integrally formed in the knit fabric and forms a part of the fabric itself. In one example, the chinstrap sock has consistent functional capabilities maintained across some or all of the complete skin-facing chinstrap sock surface including those portions with the distinct design.

In one example, the chinstrap sock comprises a circularly-knitted fabric tubular body having a double-ply knitted construction beginning with a beginning chinstrap sock welt and terminating in a finished chinstrap sock welt.

In one example, the chinstrap sock 30 is jacquard knit such that adjacent wales in at least one individual course, and in other examples, in a number of courses, are knit from visually distinct yarns. A seam, within a central portion of the tubular body that otherwise would be in contact with the wearer's skin or readily visible when the chinstrap sock 10 is used with a chinstrap, is then avoided with the chinstrap sock of the present disclosure.

In an embodiment of the present disclosure described above, which comprises one or more yarns, each of the one or more yarns providing enhanced performance characteristics, a skin facing surface of the chinstrap sock 30 is specifically knit from a yarn containing functional fiber capable of providing antimicrobial characteristics to the chinstrap sock while the opposed surface of the chinstrap sock being formed from one or more yarns substantially excluding the functional fiber providing antimicrobial characteristics.

Examples of yarns having functional fibers includes yarns made from functional fibers having elasticity, moisture management, antimicrobial, and thermal regulation properties when used in making knitted articles.

For example, an example of a yarn having elastic functional fiber includes yarns of nylon and/or polyester fibers. An exemplary elastic yarn includes spandex, ELASTANE™, ELASTIL™, and the like.

For example, a yarn having moisture management function can be used in the production of the chinstrap sock, where such yarn would comprise hydrophilicfiber including one or more hydrophilic fibers of nylon, polyester, acrylic, wool, or their blends. Such hydrophilic fibers and yarn therefrom would provide moisture wicking, e.g., sweat would be drawn up for example, by capillary action created by one or more of cohesion and adhesion interactions between moisture and the yarn, but not necessarily include absorption of the moisture by the yarn.

In one example, moisture absorbing yarns can be used in the production of the chinstrap sock. Examples of yarns with moisture absorbing fibers include yarns comprising fibers of cotton and cotton blends. Moisture absorbing yarns can be used, if desired, to complement the aforementioned moisture wicking yarns of the chinstrap sock.

In one example, a yarn having moisture repellency function (hydrophobicity) can be used in the production of the chinstrap sock, where such fiber would comprise fiber including one or more hydrophobic fibers that repel moisture, for example, polypropylene, such as microporous polypropylene.

An example of a yarn having an antimicrobial functional fiber includes yarns comprising a metal-containing fiber. An exemplary metal-containing fiber includes copper-containing fiber such as those sold by Cupron Inc. (Richmond, Virginia).

An example of a yarn comprising a functional thermal regulating fiber is yarn sold under the trade names COOLMAX™ and THERMAX™ by DuPont, Inc.

In the production of the chinstrap sock, a combination of yarns may be used, for example one or more of the elastic yarns, moisture wicking yarns, antimicrobial yarns, and thermal regulating yarns. In one example, hydrophobic yarns adjacent hydrophilic (one or more of the, moisture wicking and moisture absorbing) yarns are used. In another example, hydrophobic yarns are configured adjacent hydrophilic (one or more of the, moisture wicking and moisture absorbing) yarns, in combination with elastic yarns. In another example, metal-, metal oxide-, and/or metal salt-containing hydrophobic yarns are configured adjacent hydrophilic (one or more of the moisture wicking and moisture absorbing) yarns, in combination with elastic yarns.

In another example, hydrophobic yarns are configured to be substantially adjacent a wearer's skin and hydrophilic (one or more of the moisture wicking and moisture absorbing) yarns are configured to be distal the wearer's skin, and adjacent to the hydrophobic yarns. In another example, metal-, metal oxide-, and/or metal salt-containing hydrophobic yarns are configured to be substantially adjacent a wearer's skin and hydrophilic (one or more of the moisture wicking and moisture absorbing) yarns are configured to be distal the wearer's skin, and adjacent to the hydrophobic yarns.

In another example, hydrophobic yarns in combination with elastic yarns are configured to be substantially adjacent a wearer's skin, and hydrophilic (one or more of the moisture wicking and moisture absorbing) yarns in combination with elastic yarns are configured to be distal the wearer's skin and adjacent to the hydrophobic yarns. In another example, metal-, metal oxide-, and/or metal salt-containing hydrophobic yarns in combination with elastic yarns are configured to be substantially adjacent a wearer's skin, and hydrophilic (one or more of the moisture wicking and moisture absorbing) yarns in combination with elastic yarns are configured to be distal the wearer's skin and adjacent to the hydrophobic yarns.

Other yarns may be used in combination with one or more of the elastic yarns, moisture wicking or absorbing yarns, antimicrobial yarns, and thermal regulating yarns.

In the production of the chinstrap sock, a combination of yarns may be used to provide for moisture management, for example, a moisture wicking yarn in combination with a hydrophobic yarn can be constructed with the hydrophobic yarns being substantially skin-facing and adjacent to moisture wicking yarns that are non-skin facing such that perspiration and/or sweat and body oils are repelled from the skin by the hydrophobic yarns and wicked (and/or contained) by the moisture wicking yarns resulting in improved comfort to the wearer as the perspiration and/or sweat and body oils are at least partially transported away the skin rather than moisture being transported across the fibers and towards the skin, or remaining between the skin and the fiber. This combination of yarns can further include one or more of the elastic yarns, antimicrobial yarns, and thermal regulating yarns.

Figure 2:
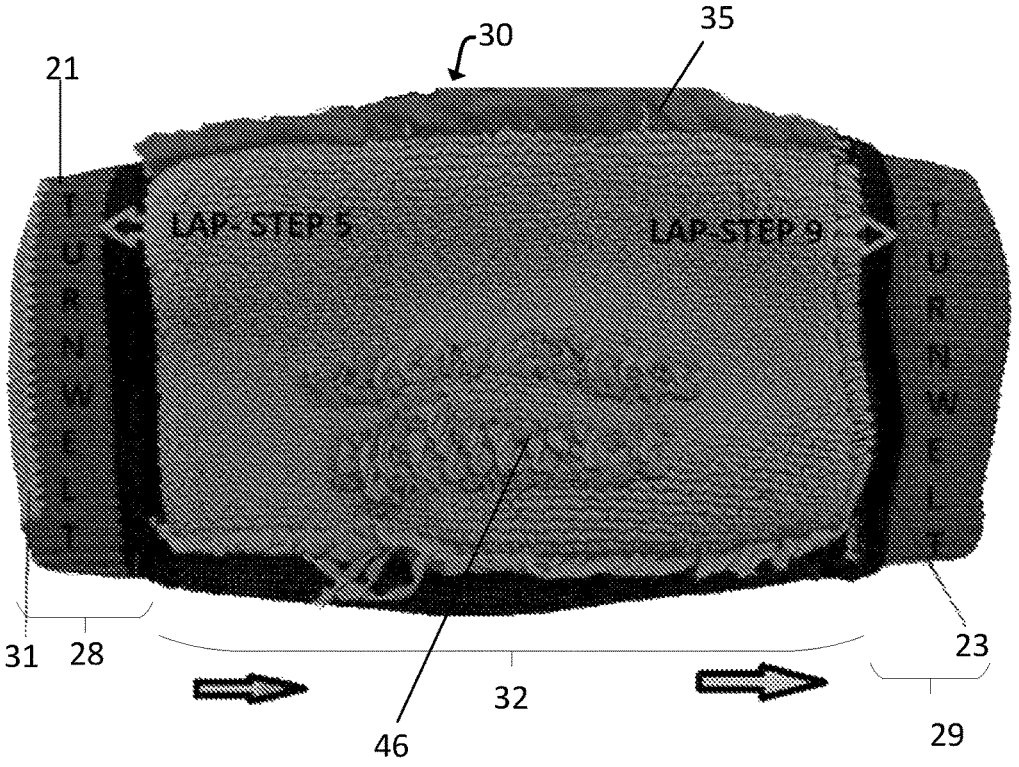
FIG. 2 depicts a perspective view of an "inside-out" view of the chinstrap sock of FIG. 1 in accordance with the present disclosure.

With references to FIGS. 1 and 2, the central portion 32 can be knit from whatever type of yarn the manufacturer desires to have form the outer visible chinstrap sock surface since in the chinstrap sock structure illustrated, the central portion 32 of the chinstrap sock structure forms the surface of the chinstrap sock which is remote from the wearer's body (in contact with the chinstrap sock itself) to which the chinstrap sock is used. In one example, the central portion 32 is knit from all or substantially all moisture wicking yarns, since such yarns have good moisture wicking capabilities. In another example, the central portion 32 is knit from all or substantially all moisture wicking yarns in combination with an antimicrobial yarn such as metal-containing yarn, for example, a yarn comprising copper-containing fiber, such as is sold by Cupron Inc. (Richmond, Virginia).

In one embodiment, the chinstrap sock comprises a circularly-knitted fabric tubular body of a plurality of yarns including an elastic yarn formed in needle loops extending in circumferential courses and axial wales. The turned welt of each chinstrap sock comprises a welt beginning course, a welt ending course, and a plurality of intervening courses, the welt beginning and ending courses being connected with one another by a set of connecting needle loops formed in selected spaced wales, e.g., every fourth wale, and the intervening courses comprising needle loops formed only in wales other than the selected spaced wales and in yarn floats across such wales. Other selected spaced wales can be used.

The main chinstrap sock body portion preferably includes at least one selected courses which have needle loops formed in every wale and, thus, the main chinstrap sock body portion is of a greater diameter than the turned welt of the chinstrap sock as a result of the absence of needle loops in the selected spaced wales of the welt's intervening courses, thereby forming the chinstrap sock of a tapered configuration.

For example, in one example, the main chinstrap sock body portion of the chinstrap sock comprises a first annular region adjacent the turned welt having courses formed of alternating needle loops and yarn floats and courses formed entirely of successive needle loops appearing in every wale, and a second annular region adjacent the first annular region having courses formed of alternating needle loops and tuck stitches and courses formed substantially entirely of successive needle loops appearing in every wale.

In one example, both S-twist and Z-twist fibers are used as one unit for one or more portions of the chinstrap sock. In another example, a Z-twist fiber is used for backing or loading the dial jacks of the circular knitting machine. In yet another example, alternating and intervening courses of the circularly-knitted fabric tubular body with S-twist and Z-twist yarns are used so as to cooperatively provide a flattening effect on the fabric of the tubular body.

Alternatively, a ribbed texture on one or more of the skin facing or opposing sides of the chinstrap sock are provided. A ribbed texture, for example, can be provided using a 1×1 tuck high selection with the elastomeric yarn feed, e.g., one needle up (elastomeric yarn in needle) and one needle down (no elastomeric yarn in needle) and repeating that pattern 360 degrees about the circular arrangement of needles. Other ribbing selections, as are known, can be chosen.

As best seen in FIGS. 1-2, the chinstrap sock 30 is predominantly of a circularly-knitted construction for economical conservation of materials, with an annular beginning welt 21 and an annular finished welt 23 at the outer axial end of the chinstrap sock, each of the welts 21, 23 integral with the central body portion 32. In one example, each chinstrap sock is formed as a circularly-knitted fabric tubular body, having a main chinstrap sock central body portion 32 substantially entirely of a single-ply knitted construction integrally knitted at its outer end with single-ply beginning and ending turned welts 21, 23.

As best seen in FIG. 1, the beginning turned welt 21 includes a continuous extent of circularly-knitted fabric with the opposite ends of the continuous extent of circularly-knitted fabric of the main chinstrap sock central body portion 32 being integrally knitted with ending turn welt 23, spaced circumferentially about the chinstrap sock.

The main chinstrap sock central body portion 32 is immediately adjacent and directly knitted integrally with the turned welts 21, 23 and generally follows the same stitch construction of the turned welt 21 for a relatively short axial extent of the chinstrap sock, e.g., approximately one-half inch, and then can be configured to merge integrally into a predominant ribbed region of the main chinstrap sock central body portion 32. In one example, the relatively short axial extent constitutes a lap.

While in the example illustrated, the length of the turn welt sections 28 and 29 are substantially equal, each welt section can be of different length. In one example, yarn without functional fiber can form substantially the entire inner/non-skin-facing surface 35 that contacts the chinstrap, whereas, yarn with functional fiber can form substantially the outer/skin-facing surface 34 of the tubular body, or the entirety of the outer surface 34 of tubular body that contacts the skin of the wearer. In one example, the sum of the lengths of turn welt sections 28, 29 are substantially less than the length of the central portion 32.

Thus, in one example, the central portion 32 is formed from at least one yarn with functional fiber as the outer/skin-facing surface 34, with inner/non-skin-facing surfaces being formed from a yarn without the functional fiber. As a further alternative, the entire chinstrap sock 30 could be knit from at least one yarn with a functional fiber, at least two yarns each with a functional fiber, or at least three yarns or more, each with a functional fiber or combination thereof. Similarly, the non-skin facing surface 35 and the skin-facing surface 34 of the chinstrap sock 30 can be knit to have the same aesthetic design, or alternatively to have contrasting or coordinating aesthetic designs, as shown in the figures.

FIG. 2 illustrates the chinstrap sock 30 of FIG. 1 as it appears in "inside out" form. Yarns which are presented but not selected by the pattern mechanism at particular needles form floats 46 along the non-skin contacting side of the fabric. Floats 46 can provide for indicia, logo's, or other textual or symbolic forms or formats.

Exemplary Manufacturing Method

A method of producing a chinstrap sock is provided, the method comprises knitting, using a patterning mechanism, a small diameter tubular body so as to integrally form a defined side or portion of the tubular body by causing one or more individual courses to have adjacent wales knit from the one or more functional yarns.

Basically, the knitting of each chinstrap sock comprises the steps of forming, on the circular knitting machine, an annular turned welt presenting a beginning chinstrap sock welt, knitting integrally to the beginning welt an annular main chinstrap sock body portion of a single-ply knitted construction, ending at an annular ending turned welt, and then discharging from the knitting machine the integral welts and main chinstrap sock body portion as a discrete, complete chinstrap sock upon completion of the knitting. Thus, the method of manufacturing of the tubular body defining the chinstrap sock avoids inner and outer nested tubes axially defined by folding. The ends of the presently disclosed chinstrap sock structure are secured without removal of the tubular body from the circular knitting machine so as to prevent or eliminate unwinding of the yarn during use as well as the need for cutting and/or joining using seams or stitching. In one example, the ends of the structure are secured using a pattern mechanism coupled to the circular knitting machine prior to removal of the tubular body from the circular knitting machine.

The chinstrap sock and method of manufacturing disclosed herein comprises yarn comprising functional fiber providing antimicrobial properties forming a major portion of the skin facing section of the chinstrap sock. For example, where a functional yarn having antimicrobial functionality is used alone or in part to form the skin facing portion of the tubular body preventing or eliminating skin issues of the user during use. In another example, a yarn comprising functional fiber having antimicrobial functionality is used in combination with another yarn having functional fiber providing wicking functionality (i.e., a metal-, metal oxide-, and/or metal salt-containing hydrophobic or super hydrophobic fiber-based yarn) adjacent a hydrophilic yarn (nylon, polyester, wool or blends thereof) configured for wicking moisture from a wearer's skin and facilitating transport to at least a portion of the outer surface of the tubular body for evaporation, or by absorption by a moisture absorbing yarn comprising moisture absorbing functional fiber (i.e., a cotton or cotton blend yarn). Other yarns with unique functional fiber characteristics can be used in combination with the above.

Thus, in one example of the manufacture of the disclosed chinstrap sock, a circular knitting machine is used such as a Santoni MECMOR™ or Lonati SM-DJ series circular knitting machine, while a cylinder of the circular knitting machine is in counter clockwise motion (s-direction), a second feed 1×1 needle selection is activated and a yarn finger is lowered so that needles take in a first yarn, an elastic yarn (also known as the "make-up") for 2 revolutions of the cylinder. With the main feed (the first feed) needles in clear high position and with alternate 1×1 needles selected (opposite the 1×1 needles on second feed), a yarn finger on main feed is lowered mid height so that needle hooks take the functional yarn in so as to start making stitches around the elastic yarn.

In one example, a small diameter circular knitting machine such as a sock or hosiery machine is used to knit a tubular fabric that ultimately becomes the presently disclosed chinstrap sock. In one example, the knitted chinstrap sock is formed on a circular knitting machine which may be of a single or multi-feed type commonly known within the knitting industry. Such knitting machines basically include a rotatable needle cylinder of a relatively small diameter with axial needle slots formed in spaced relation to one another about the outer circumferential surface of the cylinder. A plurality of latch-type knitting needles, each having a yarn receiving hook and a closable latch assembly, are reciprocally disposed within the axial cylinder slots.

In other examples, the circular knitting machine has a plurality of knitting stations at which yarn feeding fingers or other feeding instruments are positioned into and out of yarn feeding disposition adjacent the upper end of the needle cylinder's so as to feed one or more of the multiple yarns to the needles. In one example, a circular knitting machine having two, three or four knitting stations are used. The needles are operatively manipulated within their respective slots of the cylinder by stationary cams positioned adjacent the cylinder to engage and act on cam butts formed on the needles during the rotation of the needle cylinder. In one example, the circular knitting machine is operable to carry out the knitting of each chinstrap sock beginning with a first welt and continuing therefrom through the main chinstrap sock body portion and terminating at a second welt.

A patterning mechanism associated with the circular knitting machine is utilized during the knitting process to select which yarn from a plurality of yarns accessible by the knitting machine will be fed to each needle on the knitting cylinder during each course. The patterning mechanism is further configured to determine which of a plurality of yarns provided will be fed to each individual needle in a predetermined manner so as to form a predetermined pattern. An exemplary patterning mechanism is a control drum or similar control arrangement of conventional construction provided on the circular knitting machine for determining the necessary transitional changes in the machine operation to form each portion or pattern of the chinstrap sock.

The needle and yarn manipulations carried out by the circular knitting machine serves to stitch the yarns fed to the needles at the various knitting stations into successive needle loops which extend in the resultant fabric in circumferentially-extending courses of needle loops and axially-extending wales of needle loops, for example, forming "ribbing" in the tubular body of the chinstrap sock.

In one example, a plurality of yarn positions used on a main feed, 1 yarn used on a body yarn elastic feed, and up to 6 color and/or functional fiber based yarn feeds used for patterning. In one example, 5 yarn positions are used on a main feed with spandex used as a body yarn, and up to 6 color and/or functional fiber based yarn feeds used for patterning.

As will be readily understood by those persons skilled in the art, knitted chinstrap socks can alternatively be fabricated in a variety of knitted constructions, using a variety of circular knitting machines, for example but without limitation, knitting machines having a greater or fewer number of knitting stations and yarn feed fingers and knitting machines having a dial with reciprocal dial transfer jacks or other dial elements.

In one example, a different variety of yarn choices are presented at each course, if desired, subject to the functionality desired, complexity of the pattern mechanism and/or space considerations. In one example, courses are formed successively one above the other, providing a plurality of possible yarn and pattern variations over the length and width of the tubular body.

In one example, adjacent wales in an individual course are knit using the circular knitting machine from yarns which are compositionally different from each other to provide different functionality. In another example, adjacent wales in an individual course are knit from yarns which are visually distinct from each other, to provide visual functionality and/or aesthetics. Visually distinct includes yarn thickness, texture, and/or color. In other examples, adjacent wales in an individual course are knit from yarns which are yarns which are compositionally and visually different from each other to provide functionality and aesthetics to the chinstrap sock.

Various additional or alternative yarns could be utilized, including additional elastic yarns. In one example, yarns having opposing S and Z twists to counteract one another and, in turn, cooperate in imposing a flattening effect on the knitted fabric can be employed, whereby the torque of the yarns counteract one another to flatten the tubular fabric, if desired.

An exemplary method for the knitting of the chinstrap sock 30, a circular knitting machine is initially set up with one yarn feeding finger at each of multiple knitting stations of the circular knitting machine equipped with an appropriate elastic (multi-) filament, e.g., polyester or nylon yarn, suitable for forming the main fabric structure (body yarn) of the chinstrap sock. In addition, a designated one of the knitting stations is set up with another of its yarn feeding fingers equipped with a metal-containing yarn to be fed to the needles simultaneously with the body yarn at such knitting station.

With the second feed needle selection switching to the same selection as the first feed, the dial cam is activated to extract the dial jacks in between the 1×1 needle selection so that the functional yarn now lays over the selected dial jacks and ties in to previous stiches/make-up for one revolution.

After the dial jacks are loaded with yarn, the dial cam is deactivated, the first feed needle selection changes to select all needles up clear high and the yarn finger selection on first feed changes from one finger to three for a width of ten needles, providing "a lap." Then, the original first feed finger comes out of needle selection.

A welt is made, e.g., corresponding to welt 21, as the dial jacks continue to hold on to the functional yarn as the cylinder continues in the s-direction for a number of revolutions providing "an inside welt."

The process then diverts to formation of an outside of the welt with the first feed finger change and pattern activation. This pattern allows for providing metal-containing yarn on the skin-side while having a hydrophilic yarn opposed surface away from the skin. The first feed finger change inserts backing yarns (spandex, hydrophilic yarn) and after the lap, the inside welt yarns come out of needle selection. The metal-containing yarn comes from 1 of 6 pattern feeds and ties into the first feed backing yarn, but is plaited to the outside/skin-side. The outside welt revolutions closely match the inside welt revolutions so that the metal-containing yarn is at the crest 31 of the first welt 21.

While the skin-side pattern continues until it is time to end the welt by extracting the dial jacks (as all needles are being selected,) the metal-containing yarn that was on the dial jacks are knit in as the dial jacks are pulling back in, releasing the metal-containing yarn from the jacks and into the needles, With the first welt 21 of the tubular body of the chinstrap 30 formed, the skin-side pattern runs for approximately 90 revolutions and/or until it is time to create the second welt 23 (as shown by arrows 36). Thus, as the skin-side pattern continues the dial jacks are extracted once more and a yarn finger lowered mid height to load dial jacks as before to create the second welt 23 as described above.

Forming the outside of the second welt 23 is as described above, (only in reverse), as the outside of the second welt is made first moving to the inside. A finish-line step ends the knitting so that the yarns will not unravel.

In one example, the second feed yarn is spandex or similar elastic yarn that the circular knitting machine has been programmed in such a way that the second feed yarn feeder runs very slow to tighten or tension the end of the welt in the first welt and gradually loosens tension through about midway of the tubular body of the chins-sock and then to begin gradually tighten or tension subsequent to formation of the second welt so as to approximately match the yarn tension of the first welt.

In one example, a number of wales forming a skin-contacting side 34 of the chinstrap 30 (i.e. the wales along a portion of the tubular circumference of the chinstrap) can be knit from a yarn with functional fiber such as those described above, while a non-skin-contacting side 35 can be knit from a different type or types of yarns, in order that skin-contacting surface of the finished chinstrap sock will have enhanced performance characteristics, such as one or more of increased antimicrobial, wicking, or moisture absorbing capabilities. Alternatively, substantially all of the non-skin-contacting side 35 or the entire non-skin-contacting side 35 could also be knit from yarns having one or more functional fibers, either the same functional fibers or a combination of different functional fibers.

In a similar manner, a number of wales forming the non-skin-contacting side 35 of the chinstrap sock can be knit to include a first design pattern, e.g., logo, team emblem, number, etc., while the skin-contacting side 34 could be knit to exclude the pattern or provide a different pattern, depending on the desires of the manufacturer. In this embodiment of the disclosure where each of the front and non-skin-contacting sides 35 forms substantially one half of the circumference of the chinstrap sock 30, the chinstrap sock can be knit to be reversible by providing each face with a different design, thereby enabling two ornamental appearances to be provided by the same athletic bank.

Advantageously, the knitted chinstrap sock produced by the present disclosure in the manner above-described uniquely enable the methodology by which chinstrap socks are fabricated to be streamlined so as to reduce not only material costs but also fabrication time and labor costs by reducing or eliminating use of the at least one functional yarn in the formation of a wrap-around welt or seam.

As will be understood from the foregoing description, the chinstrap sock 30 in accordance with the present disclosure are knitted and cast off the circular knitting machine in the form of discrete individual chinstrap socks which are ready without any cutting, folding, stitching, or other structural modification for immediate use as a chinstrap sock. Accordingly, chinstrap socks fabricated in accordance with the present disclosure eliminate two labor-intensive steps from conventional fabrication methods and, in turn, eliminate the work-in-process inventory and storage requirements attendant to such intermediary steps. Of course, of equal significance is the advantage that the present chinstrap sock provides anti-microbial properties to the skin contacting surface, significantly reducing skin-related issues of conventional chinstrap socks.

I claim:

1. A chinstrap sock comprising a tubular body having a skin facing surface for contacting a portion of a wearer's body, and an outer surface opposed to the skin-facing surface;

an opening in the tubular body for receiving a chinstrap; and a first turned welt and a second turned welt defining opposite ends of the tubular body, each of the first turned welt and the second turned welts being in surrounding relation to the opening, the first turned welt and the second turned welt each integral with the tubular body; wherein the tubular body is of a double-ply knitted construction integrally knitted with the first and second turned welts;

wherein the tubular body comprises a hydrophobic yarn containing a metal-, metal oxide-, and/or metal salt-containing fiber and one or more yarns substantially excluding metal-, metal oxide-, and/or metal salt-containing fiber positioned between the first turned welt and the second turned welt of the skin facing surface;

wherein the skin facing surface presents the metal-, metal oxide-, and/or metal salt-containing hydrophobic yarn and the outer surface presents the one or more yarns substantially excluding metal-, metal oxide-, and/or metal salt-containing fiber between the opposite ends of the tubular body, wherein the metal-containing yarn is present at a crest of the first turned welt;

wherein the tubular body is a circularly-knitted fabric and the first turned welt, and the second turned welt are each a circularly-knitted fabric integral with the tubular body.

2. A chinstrap sock according to claim 1, wherein the metal-, metal oxide-, and/or metal salt-containing fiber comprises copper or silver.

3. A chinstrap sock according to claim 1, wherein the tubular body of the chinstrap sock includes an elastic yarn.

4. A chinstrap sock according to claim 1, wherein the skin-facing surface comprises the hydrophobic yarn and the outer surface comprises a moisture absorbing yarn opposed to the skin facing surface.

5. A chinstrap sock according to claim 1, wherein the skin-facing surface comprises the hydrophobic yarn and the outer surface comprises a moisture wicking yarn opposed to the skin facing surface.

6. A chinstrap sock according to claim 1, wherein the skin-facing surface comprises the hydrophobic yarn, and the outer surface comprise a moisture wicking yarn adjacent a moisture absorbing yarn.

7. A chinstrap sock comprising a tubular body having a skin facing surface for contacting a portion of a wearer's body, and an outer surface opposed to the skin-facing surface;

an opening in the tubular body for receiving a chinstrap; and a first turned welt and a second turned welt defining opposite ends of the tubular body, each of the first turned welt and the second turned welt being in surrounding relation to the opening, the first turned welt and the second turned welt each integral with the tubular body; wherein the tubular body is a knitted construction integrally knitted with the double-ply first and second turned welts;

wherein the tubular body is of a double-ply knitted construction comprising:

a metal-, metal oxide-, and/or metal salt-containing hydrophobic yarn, in combination with an elastic yarn, being presented proximate to a wearer's skin; and a hydrophilic yarn excluding metal-, metal oxide-, and/or metal salt-containing fiber, optionally in combination with an elastic yarn, adjacent to the hydrophobic yarn, the hydrophilic yarn configured to be distal to the wearer's skin;

wherein the skin facing surface comprises the metal-, metal oxide-, and/or metal salt-containing hydrophobic yarn at a crest of the first turned welt;

wherein the tubular body is a circularly-knitted fabric and the first turned welt, and the second turned welt are each a circularly-knitted fabric integral with the tubular body.

8. A method of preventing or eliminating skin-related adverse effects to the face of a user in need thereof, the method comprising:

providing a chinstrap sock as defined in claim 1 configured for use with a chinstrap of an athletic helmet; and preventing or eliminating skin-related adverse effects.

9. The method of claim 8, wherein the adverse effects are one or more of heat rash, sweat rash, acne, folliculitis, bacterial infection, and fabric-induced dermatitis.

* * * * *